United States Patent [19]

Pozzobon

[11] Patent Number: 4,669,201

[45] Date of Patent: Jun. 2, 1987

[54] SKI BOOT

[75] Inventor: Alessandro Pozzobon, Treviso, Italy

[73] Assignee: Nordica S.p.A., Montebelluna, Italy

[21] Appl. No.: 857,035

[22] Filed: Apr. 28, 1986

[30] Foreign Application Priority Data

May 6, 1985 [IT] Italy ..... 20577 A/85

[51] Int. Cl.[4] ..... A43B 5/04; A43C 11/00

[52] U.S. Cl. ..... 36/117; 36/50; 36/120; 24/68 SK

[58] Field of Search ..... 36/117–121, 36/50; 24/68 SK, 68 B

[56] References Cited

U.S. PATENT DOCUMENTS 4,571,855 2/1986 Blanc ..... 36/50
4,596,080 6/1986 Benoit et al. ..... 36/120

FOREIGN PATENT DOCUMENTS 0073989 3/1983 European Pat. Off. ..... 36/117
2450575 10/1980 France ..... 36/50
2475372 8/1981 France ..... 36/50

*Primary Examiner*—James Kee Chi
*Attorney, Agent, or Firm*—Guido Modiano; Albert Josif

[57] ABSTRACT

This ski boot comprises a boot shell, a front gaiter and a rear gaiter associated therewith and a gaiter closure device. The gaiter closure device presents a lever element pivoted, at one end, to either of the gaiters for rotation about the pivot axis between an open and a closed position. The lever element supports an assembly for adjusting the working length of a cable interconnecting the gaiters. The adjustment assembly has a slider engageable with the cable and movable along a direction substantially perpendicular to the pivot axis for adjusting the working length of the cable with the lever element in the open position.

5 Claims, 9 Drawing Figures

SKI BOOT

BACKGROUND OF THE INVENTION

This invention relates to a ski boot.

As is known, so-called rear entrance ski boots are closed by driving the front and rear gaiters or quarters thereof tight against each other.

To accomplish this, a number of arrangements have been proposed, among which closure levers or hooks effective to interlink the front and rear gaiters but having the disadvantage of involving separation or unhooking of the components on opening, which requires for the user additional operations to be performed at the time the boot is fastened on.

Other prior approaches make use of one or more cables which interlink the gaiters and drive them toward each other on shortening the working lengths of the cables, which is accomplished with a variety of devices.

This approach requires, in order to provide good accessibility to the boot interior on opening, relatively long cable lengths, which involves elaborate operations for both opening and closing the boot.

Further, such prior approaches require, for fastening the boot on, application of relatively large forces, which should be exerted directly on the cables through cable take-up pulleys or the like.

SUMMARY OF THE INVENTION

It is the aim of this invention to solve such problems as outlined above by providing a ski boot having a gaiter closure device which, while involving no separation of the closure components on opening, affords rapidly and easily carried operations for the user.

Within the above aim, it is a particular object of the invention to provide a ski boot which affords the so-called half-open setting whereby the rear gaiter is arranged vertically to enable the user to stand up, and which is of special utility for walking and whenever the boot is put on but without being actually involved in skiing.

Another object of this invention is to provide a ski boot whose structural arrangement is extremely simple as well as highly reliable and safe to use.

A not least object of the invention is to provide a ski boot which affords stable gaiter tightening features without involving application of any large forces.

The above aim, and these and other objects to become apparent hereinafter, are achieved by a ski boot with a gaiter closure device comprising a shell with a front and a rear gaiter associated therewith, the closure device comprising cable means connecting the gaiters and control means for controlling the working length of the cable means, characterized in that the control means for the working length of the cable means comprise a lever-like member hinged at one end thereof onto one of said gaiters, wherein the hinge axis thereof is perpendicular to the longitudinal extension of said lever-like member, a slider-like member engageable with said cable means and translatory movable along said lever-like member to approach or respectively move away from said hinge axis for the adjustment of the working length of the cable means and actuation means for the translatory movement of said slider-like member.

BRIEF DESCRIPTION OF THE DRAWINGS

Further features and advantages will be more clearly apparent from the following description of a preferred, though not exclusive, embodiment of a ski boot incorporating a gaiter closure device, shown by way of illustration and not of limitation in the accompanying drawings, where.

DESCRIPTION OF A PREFERRED EMBODIMENT

Figure 1:
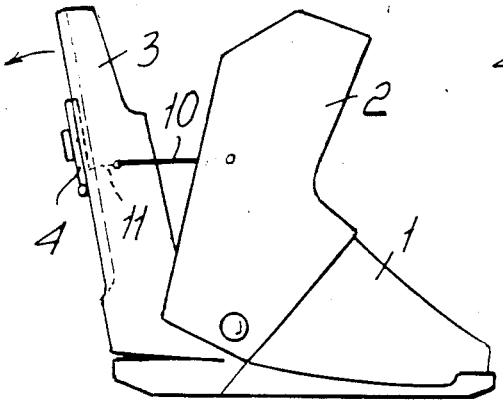
FIG. 1 shows diagrammatically this ski boot in side elevation and the open position.
Figure 2:
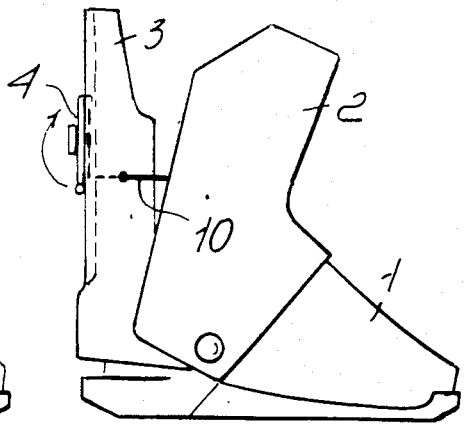
FIG. 2 is a side elevation view of the ski boot in the half-open position thereof, facilitating the walking.

With reference to the drawing figures, a ski boot, according to the invention, comprises a boot shell 1 whereto a front gaiter 2 and rear gaiter 3 are connected, in a manner known per se, and in mutually facing relationship.

One of said gaiters, e.g. the rear gaiter 3, carries a lever element 4 pivoted thereto and housed within a longitudinal depression 5 advantageously formed in the gaiter 3 itself.

The lever element 4 is pivoted at one end to ears 7, either attached on the gaiter or formed integrally therewith, through a pin 6, defining the lever pivot axis.

The lever element 4 carries an assembly for adjusting the working length of a cable 10 extending in guide channels 11 defined on the gaiter 3 and opening into the depression 5 at a location away from the pivot axis 6.

The cable 10 is tied to the front gaiter 2 with its free end.

Figure 4:
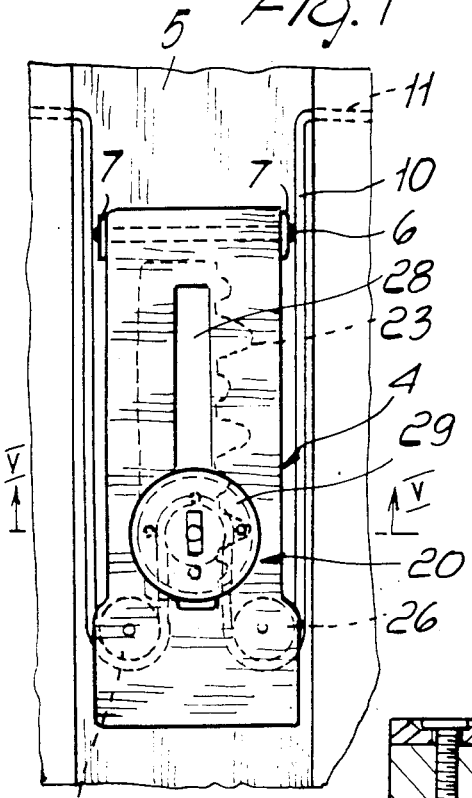
FIG. 4 details the lever element with a slider of the Maltese cross type in front elevation.
Figure 3:
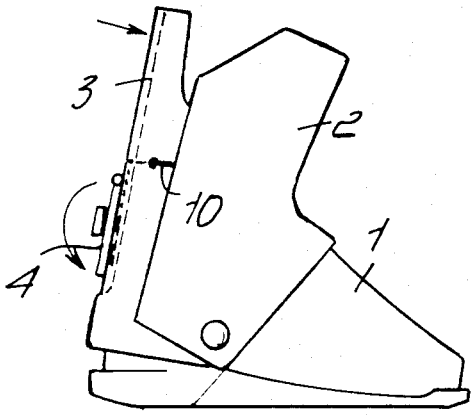
FIG. 3 shows diagrammatically the ski boot in side elevation and in the closed position.
Figure 5:
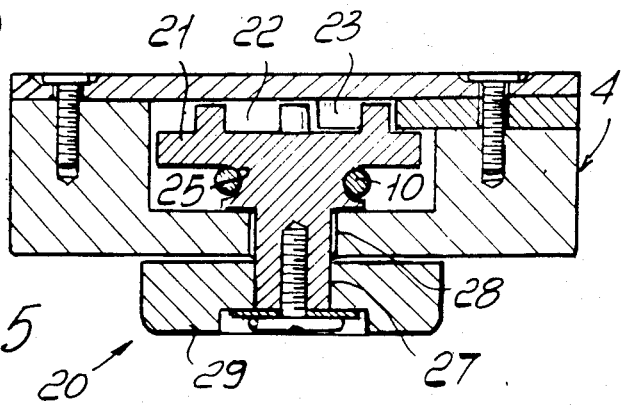
FIG. 5 is a sectional view taken along the line V—V in FIG. 4.

The cited assembly for adjusting the working length of the cable 10, as shown in FIGS. 4 and 5, has a moving slider, generally designated with the reference numeral 20, which is slidable along a direction substantially perpendicular to the pivot axis 6.

In the embodiment disclosed in FIGS. 4 and 5, the moving slider 20 has a Maltese cross body 21 that fits in a longitudinal seat 22 defined within the lever element 4 and engages with a Maltese cross tooth formation 23 defined at a longitudinal edge of the seat 22.

The Maltese cross body 21 defines a circumferential groove, indicated at 25, which engages with a middle portion of the cable 10 which is in turn wound around lay rollers 26 rotatably carried on the lever element 4 on the remote side from the pivot axis 6.

As visible from FIG. 5, the Maltese cross body 21, on the side opposite to the formation 23, has a tang 27, protruding from the lever 4 outwards through an elongate slot 28 defined by the same lever element 4. The tang 27 is rigidly connected to an actuating knob 29 which enables rotation of the Maltese cross body 21 to move it linearly along the lever element 4 in a direction which is substantially perpendicular to the pivot axis 6.

Figure 6:
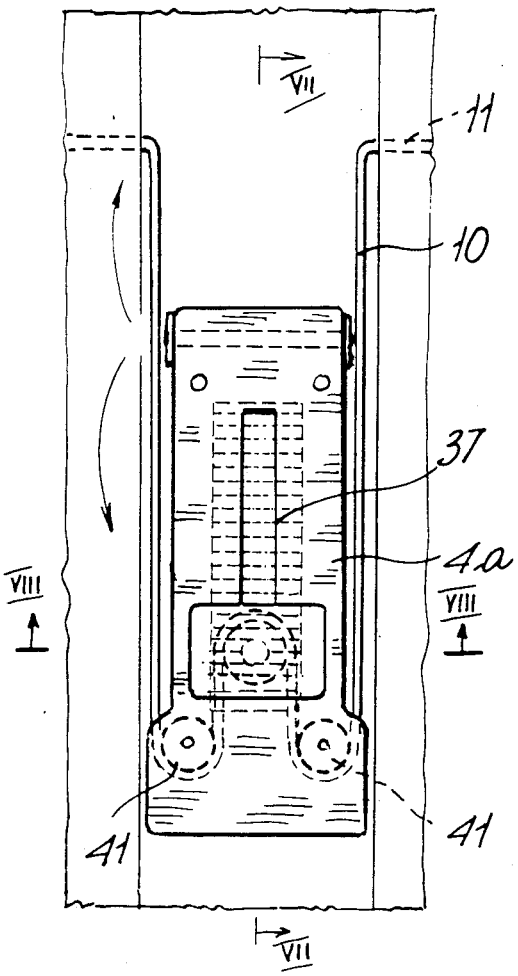
FIG. 6 details the lever element with a movable slider, in front elevation.
Figure 7:
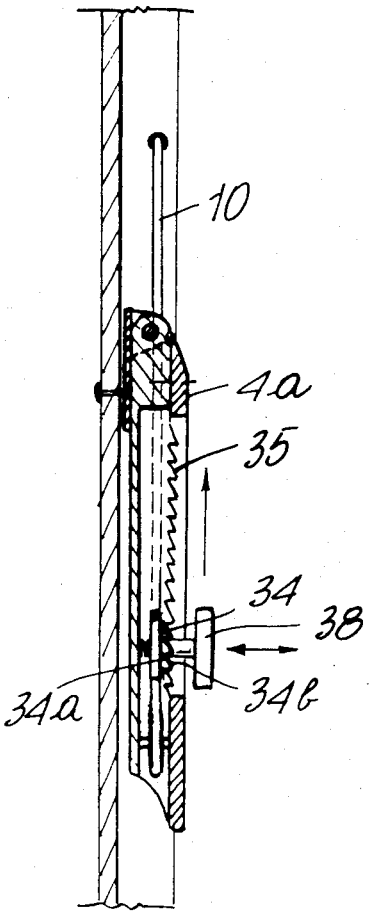
FIG. 7 is a sectional view taken along the line VII—VII in FIG. 6.
Figure 8:
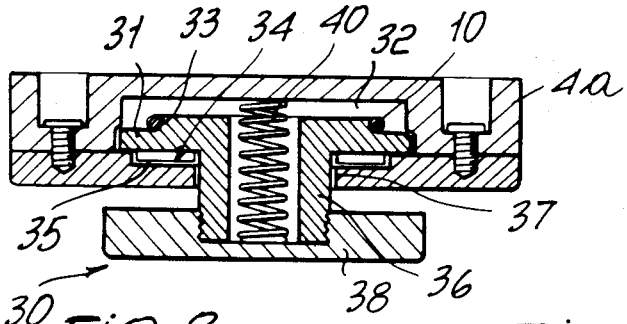
FIG. 8 is a sectional view taken along the line VIII—VIII in FIG. 6.

Making reference to FIGS. 6 to 8, a lever element, similar in principle to the former element, is provided at 4*a* and carries a moving central slider, generally designated with the reference numeral 30, which has a small plate 31 slidingly housed inside a longitudinal seat recess 32 defined by the lever 4*a*, the plate 31 defining, on one side, a notch 33 wherewith the middle portion of the cable 10 engages.

On the other side, the plate 31 defines a tooth formation 34 which engages with a mating tooth formation 35 correspondingly defined by a wall of the recess 32.

The tooth formation 34 comprises sawtooth-shaped teeth having an abutment section 34*a* and a sloping section 34*b* so arranged as to allow the teeth 34 to ride the teeth 35 in the direction corresponding to shortening the working length of the cable 10, and prevent movement in the opposite direction.

Centrally, on the same side as the tooth formation 34, the plate 31 presents a jut 36 protruding from the recess 32 and outside of the lever element 42 through an elongate slot 37 correspondingly defined by the lever element 4*a*.

Furthermore, the jut 36 is rigidly connected, on the outward face of the lever element 4*a*, to a pushbutton 38 actuatable to overcome the elastic bias of a spring 40 extending within the jut 36 and acting between a wall of the recess 32 and the slider 30 so as to hold the tooth formation 34 in elastic engagement with the mating tooth formation 35.

On depressing the pushbutton 38, the tooth formation 34 is disengaged from the mating tooth formation 35 and allows the plate 31 to slide freely within the recess 32 along a direction substantially perpendicular to the pivot axis 6 of the lever 4*a*.

The cable 10 is wound around lay elements 41 which are also supported on the lever 4*a* on the remote side from the pivot axis and located laterally of the plate 31 and the notch 33 defined thereby.

Figure 9:
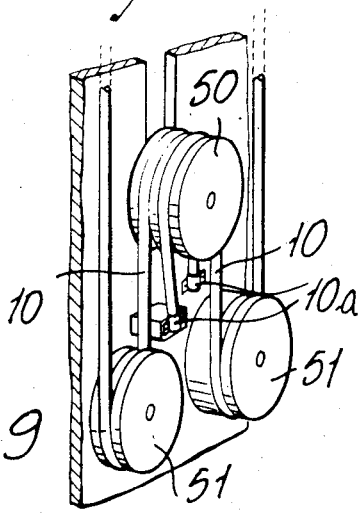
FIG. 9 details a particular arrangement of the cable directed to expand the range of adjustment of the cable length in relation to the slider movement.

If it is desired to expand the adjustment range for the working length of the cable(s) 10 with respect to the slider displacement, as shown in FIG. 9, a twin race sheave 50 may be provided on the slider. With this arrangement, the cables 10, having their ends secured to the lever element 4*a* at 10*a*, are wound around the sheave 50 and the lay pulleys 51, arranged laterally of the sheave 50. Preferably the fixed points 10*a* are located at an area approximately level with said lay pulleys 51.

With the arrangement described hereinabove, with the lever 4, 4*a* in the open position, the user can act on either the moving slider 20 or 30 to change the cable working length and bring about, during the closing step, a first mutual approaching movement of the rear and fron gaiters until a position is reached where the rear gaiter is substantially upright, which favors the user's walking.

With this setting, which may be referred to as a half-open condition, the foot will be held within the boot but the boot will not be made fast.

To tighten the gaiters it will be sufficient to act on the lever turning it about its pivot axis 6 to the closed position, tilted of 180° (in the drawing downwardly) with respect to the opened position.

In this condition, the gaiters will be tightened against each other by the pull applied from the cable 10.

To open the boot, it is necessary firstly to turn the lever 4 or 4*a* up to the open position, and then manipulate the slider 20 or 30 to lengthen the cable working length as desired to allow the boot to be opened completely.

It may thus be appreciated from the foregoing description that the invention achieves the objects set forth, and in particular the fact is emphasized here that a ski boot is provided wherein the gaiter closure device is operated in two separate steps, that is a first step wherein the gaiters are brought close together and which is carried out without imposing a pull on the cable, thereby the approaching movement is achieved rapidly and without significant effort.

Further, this arrangement results in a displacement of the slider determining a change in the cable working length which amounts to twice the slider displacement length, thereby allowing the utilization of lever elements 4 or 4*a* of relatively small dimensions.

Further, the boot can be tightened quickly by just manipulating the lever element.

The invention herein is susceptible to many changes and modifications within the inventive concept.

Furthermore, all the details may be replaced with technical equivalents thereof.

In practicing the invention, the materials used, so long as compatible with the specific use, as well as the dimensions and contingent shapes, may be any ones as required.

I claim:

1. A ski boot with a gaiter closure device, comprising a shell with a front and a rear gaiter associated therewith, the closure device comprising cable means connecting the gaiters and control means for controlling the working length of the cable means, wherein the control means for the working length of the cable means comprise a lever member having a longitudinal extension and hinge means defining a hinge axis on one end thereof, thereby said lever member being hinged at one end thereof onto one of said gaiters, wherein said hinge axis thereof is perpendicular to the longitudinal extension of said lever member, a slider member engageable with said cable means and translatory movable along said lever member to approach or respectively move away from said hinge axis for the adjustment of the working length of the cable means and actuation means for the translatory movement of said slider member, wherein said cable means comprise at least one cable having a middle portion which engages said slider member, said cable extending at least partially within guide channels formed in said one of said gaiters in the proximity of said lever member at a location offset with respect to said hinge axis, said cable having a free end connected to another of said gaiters and wherein said slider member comprises a moving slider element including a Maltese cross body, said lever member having a seat defined therein in which said Maltese cross body is housed , said seat having a longitudinal edge with a Maltese cross formation thereon, said Maltese cross body being engageable with said Maltese cross formation.

2. A ski boot according to claim 1, wherein said Maltese cross body defines a groove engageable with said middle portion of said cable.

3. A ski boot according to claim 1, wherein said lever member has an elongate slot defined therein and wherein said Maltese cross body has a raised portion protruding from said seat through said elongate slot and an actuating knob connected to the free end of said raised portion.

4. A ski boot according to claim 1 further comprising lay rollers arranged laterally of said Maltese cross body and supported on said lever member at a position away from said hinge axis and wherein said cable is wound over said lay rollers.

5. A ski boot according to claim 1, further comprising lay pulleys supported on said lever member which has a pivot point thereof, a pair of cables and a twin race sheave carried on said slider member and forming a guide for said pair of cables wound around said lay pulleys arranged laterally of said twin race sheave and located away from the pivot point for said lever, said cables being rigidly attached to said slider member at a point located between said lay pulleys.

* * * * *